US009848713B2

(12) United States Patent
Rosen et al.

(10) Patent No.: US 9,848,713 B2
(45) Date of Patent: Dec. 26, 2017

(54) CONVERTIBLE INFANT CARRIER

(71) Applicant: Gold, Inc., Aurora, CO (US)

(72) Inventors: Lynn Rosen, Parker, CO (US); Sunny K. Beermann, Denver, CO (US); Cynthia R. Nelson, Longmont, CO (US)

( * ) Notice: Subject to any disclaimer, the term of this patent is extended or adjusted under 35 U.S.C. 154(b) by 176 days.

(21) Appl. No.: 14/595,044

(22) Filed: Jan. 12, 2015

(65) Prior Publication Data

US 2015/0196133 A1 Jul. 16, 2015

Related U.S. Application Data

(60) Provisional application No. 61/926,059, filed on Jan. 10, 2014.

(51) Int. Cl.
*A47D 13/02* (2006.01)
*A61G 1/00* (2006.01)

(52) U.S. Cl.
CPC ..... *A47D 13/025* (2013.01)

(58) Field of Classification Search
CPC Y10T 24/45995; A47D 13/02; A47D 13/025; A61G 1/00
USPC ..... 224/160, 159, 259, 262
See application file for complete search history.

(56) References Cited

U.S. PATENT DOCUMENTS 4,009,808 A * 3/1977 Sharp ..... A47D 13/025 224/160
4,271,998 A * 6/1981 Ruggiano ..... A47D 13/025 224/160
4,986,458 A * 1/1991 Linday ..... A47D 13/025 224/160
5,020,709 A * 6/1991 Hoaglan ..... A47D 13/025 224/155
5,205,450 A * 4/1993 Derosier ..... A47D 13/025 224/161
5,692,655 A * 12/1997 Fair ..... A47D 13/025 224/160
5,711,466 A * 1/1998 Kataoka ..... A47D 13/025 224/159
5,732,861 A * 3/1998 Jakobson ..... A44B 11/2549 224/158
D395,161 S * 6/1998 Fair ..... D3/214
5,791,535 A * 8/1998 Roan ..... A47D 13/025 224/153
5,813,580 A * 9/1998 Fair ..... A47D 13/025 224/160
5,848,741 A * 12/1998 Fair ..... A47C 7/66 224/160
5,964,470 A * 10/1999 Syendsen ..... A47D 13/025 224/153
6,017,088 A * 1/2000 Stephens ..... A47D 13/02 292/50
6,619,519 B1 * 9/2003 Nix ..... A45C 7/0086 224/153
6,672,493 B1 * 1/2004 Fair ..... A47D 13/025 224/160

(Continued)

*Primary Examiner* — Brian D Nash

(74) *Attorney, Agent, or Firm* — Reilly Intellectual Property Law Firm

(57) ABSTRACT

An infant carrier having a main panel support member, dual padded shoulder strap members, a waist belt, a removable infant insert and a padded head support convertible between a front, hip and back infant carrier.

17 Claims, 11 Drawing Sheets

(56) References Cited

U.S. PATENT DOCUMENTS 6,938,958 B2 * 9/2005 Gold ..... A47D 15/006 297/393
6,988,644 B1 * 1/2006 Asherbranner ..... A47D 13/025 224/160
7,484,645 B2 * 2/2009 Hoff ..... A47D 13/025 224/159
7,819,831 B2 * 10/2010 Dellanno ..... A47D 13/025 128/870
7,886,946 B2 * 2/2011 Gray ..... A47D 13/025 224/158
8,172,116 B1 * 5/2012 Lehan ..... A45F 3/04 224/159
8,256,073 B2 * 9/2012 Zhang ..... A44B 11/266 224/161
8,490,844 B2 * 7/2013 Favorito ..... A47D 13/025 224/159
8,752,739 B2 * 6/2014 Bergkvist ..... A47D 13/025 224/158
9,022,260 B2 * 5/2015 Frost ..... A47D 13/025 224/159
9,357,852 B2 * 6/2016 Salazar ..... A47D 13/025
9,380,887 B2 * 7/2016 Frost ..... A47D 13/025
9,439,515 B2 * 9/2016 Kim ..... A45F 3/04
2001/0030210 A1 * 10/2001 Donine ..... A47D 13/025 224/160
2005/0045674 A1 * 3/2005 Rehbein ..... A47D 13/025 224/160
2005/0184114 A1 * 8/2005 Hoff ..... A47D 13/025 224/160
2007/0029356 A1 * 2/2007 Moriguchi ..... A47D 13/025 224/160
2008/0283559 A1 * 11/2008 Parness ..... A47D 13/025 224/159
2009/0206116 A1 * 8/2009 Grant ..... A45F 3/08 224/160
2010/0072236 A1 * 3/2010 Parness ..... A47D 13/025 224/161
2011/0062195 A1 * 3/2011 Jones ..... A47D 13/025 224/161
2011/0290831 A1 * 12/2011 Wang ..... A47D 13/025 224/160
2012/0298702 A1 * 11/2012 Jung ..... A47D 13/025 224/158
2014/0263491 A1 * 9/2014 Telford ..... A47D 13/025 224/160
2014/0296045 A1 * 10/2014 Krstanoski-Blazeski ..... A47D 13/025 482/139
2016/0270555 A1 * 9/2016 Telford ..... A47D 13/025

* cited by examiner

CONVERTIBLE INFANT CARRIER

The present application is a utility conversion of provisional patent application Ser. No. 61/926,059 filed 10 Jan. 2014, for CONVERTIBLE INFANT CARRIER and herein incorporated by reference.

The following relates to an infant carrier and more particularly relates to a novel and improved infant carrier that is designed to support newborns and may be converted from a front infant carrier to a hip carrier or back carrier.

BACKGROUND AND FIELD

Infants are often carried next to the body of an adult in an infant carrier and many carriers have been designed to accomplish this result while attempting to minimize the stress and fatigue that can result from carrying an infant. Often the wearer of the carrier becomes fatigued and suffers back pain as a result of carrying an older infant in a front carrier. Further, the carriers are often difficult to assemble and put on, uncomfortable to wear for extended periods of time due to uneven weight distribution of the infant and must be completely disassembled in order to remove the infant.

An infant carrier has been devised which includes an infant support member made of a light flexible, breathable fabric, padded shoulder support straps, a modified waist belt that includes lumbar support and a removable infant insert for placement of a smaller infant therein. The removable infant insert with hook and loop fasteners and quick release buckles and webbing straps is secured to the support member with hook and loop tabs. The padded shoulder pads are designed to evenly distribute the weight of the infant along the shoulders of a wearer while promoting proper posture of the wearer as well. A sternum/back strap on the shoulder straps provides for horizontal and vertical adjustment. A pull-out, padded headrest is also provided that provides back or neck support for a larger infant and support for the head of a smaller infant. An infant may be placed securely within the carrier to face the wearer in front carrier mode, to face the side of the wearer in hip carrying mode or facing the back of the wearer in back carrying mode. The above and other features will become more readily appreciated and understood from a consideration of the following detailed description of different embodiments when taken together with the accompanying drawings in which:

DETAILED DESCRIPTION

Figure 1:
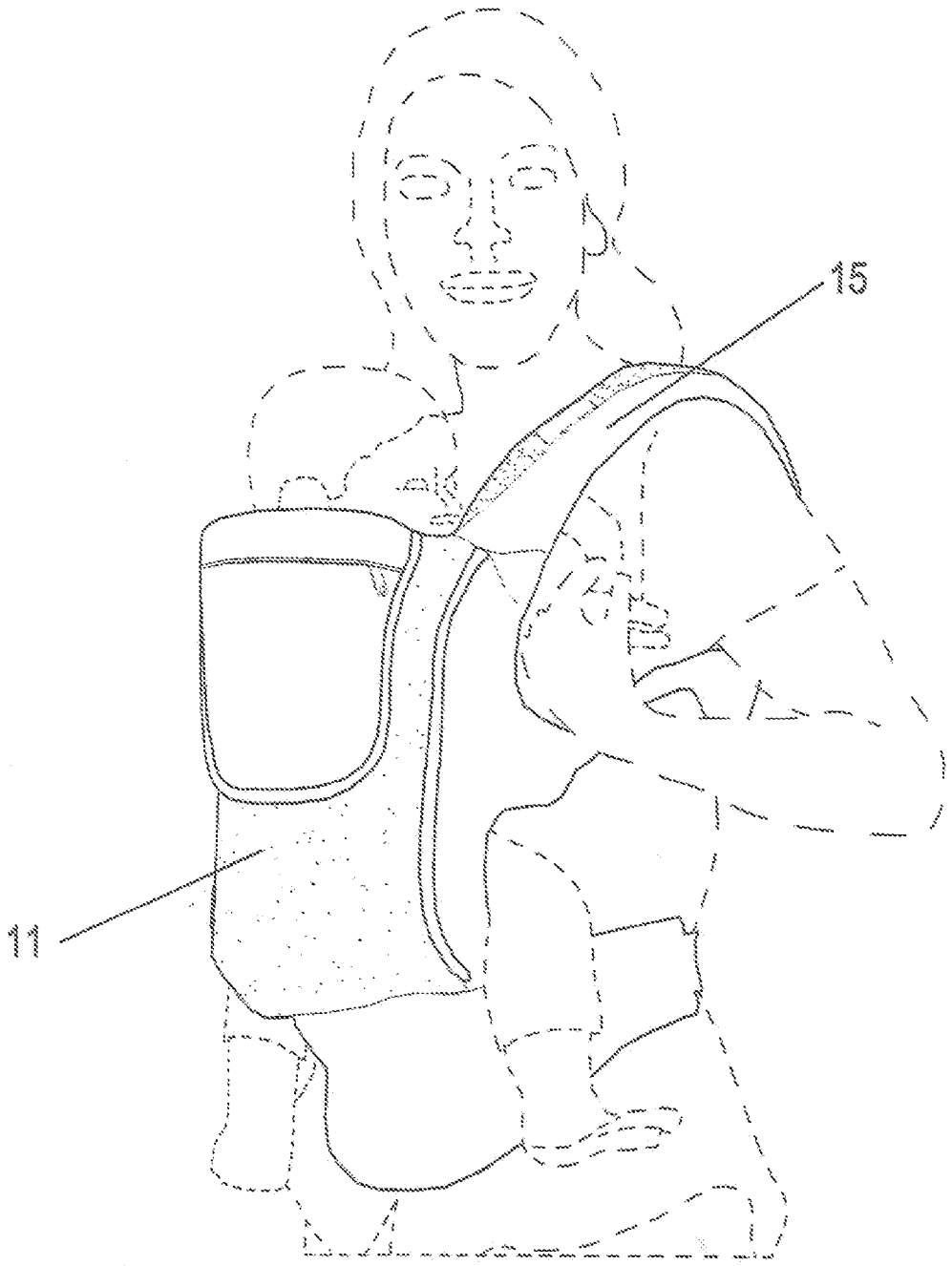
FIG. 1 is a side perspective view of an infant support carrier.
Figure 2:
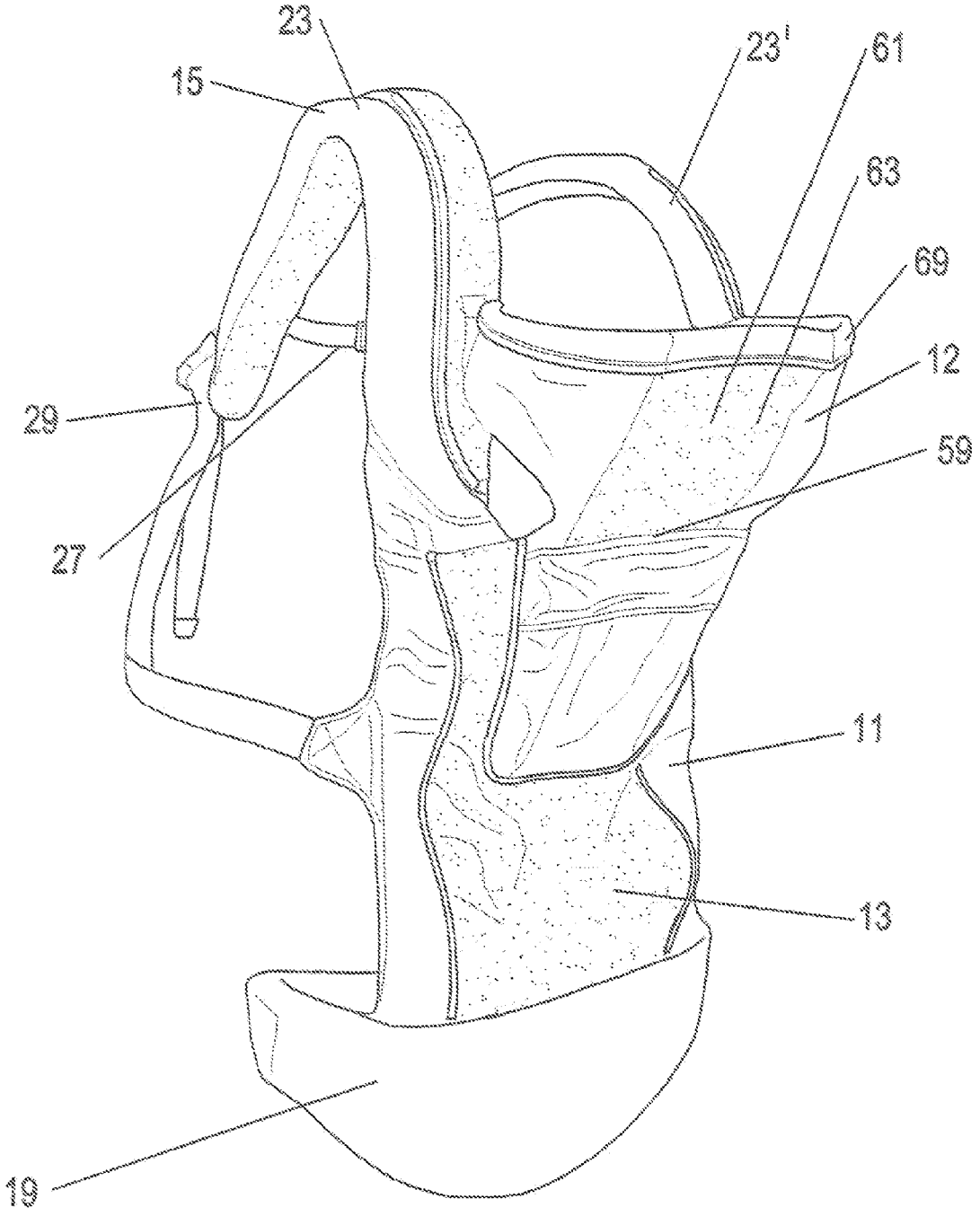
FIG. 2 is a perspective view of the carrier of FIG. 1 with an extended headrest.
Figure 3:
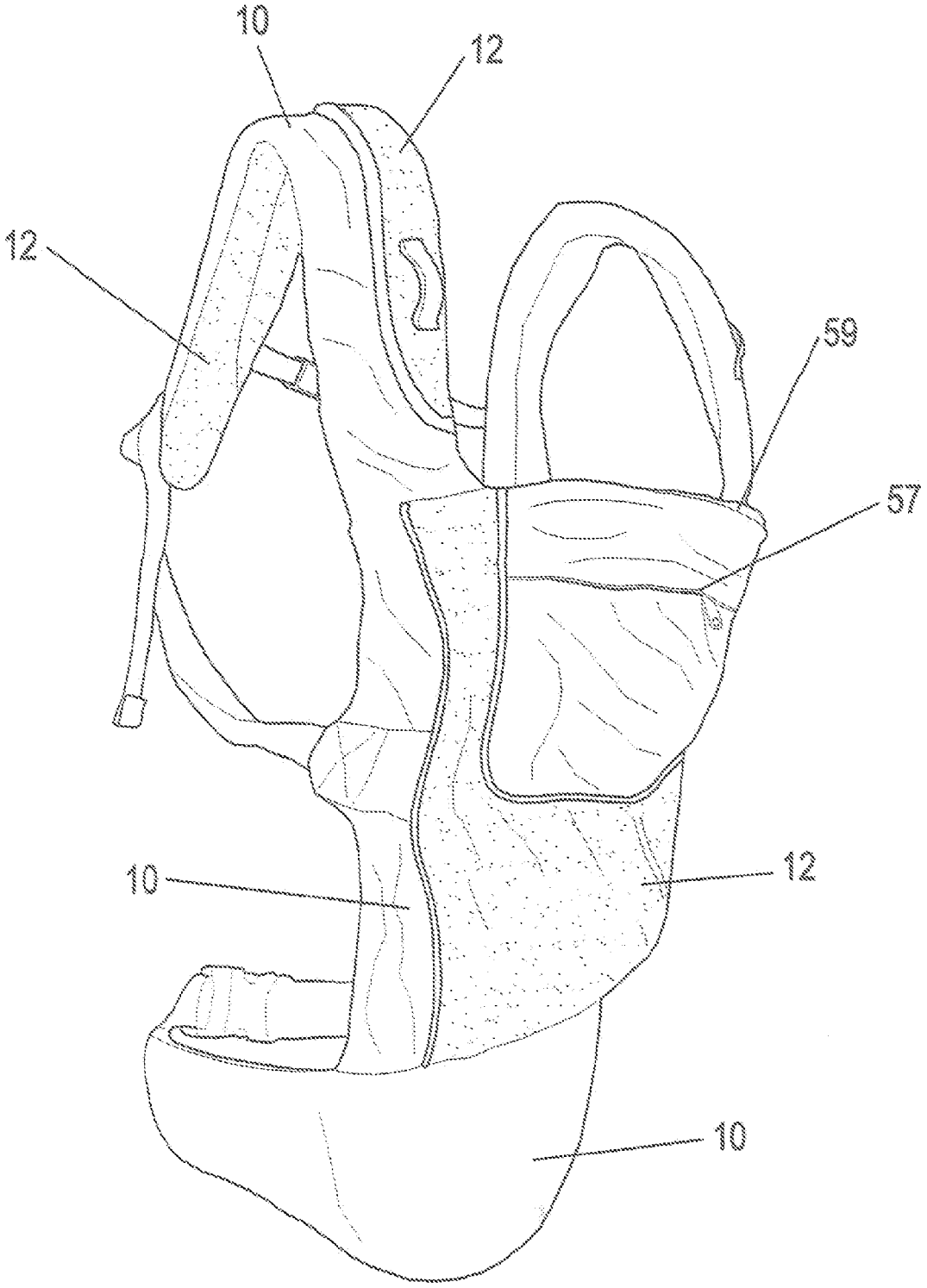
FIG. 3 is a perspective view of the carrier of FIG. 1 with the headrest stored in the carrier.
Figure 4:
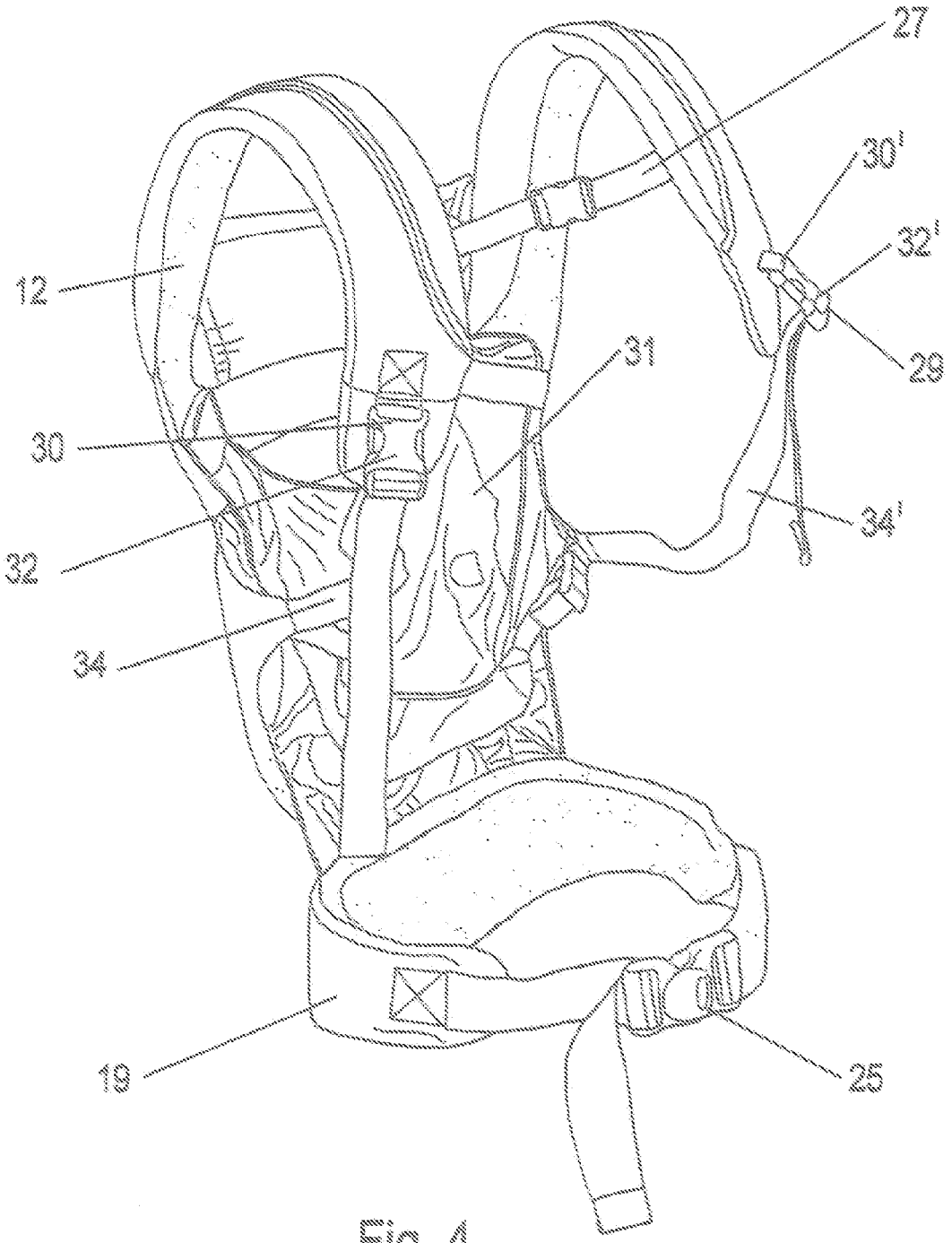
FIG. 4 is a rear perspective view of the carrier of FIG. 1.
Figure 5:
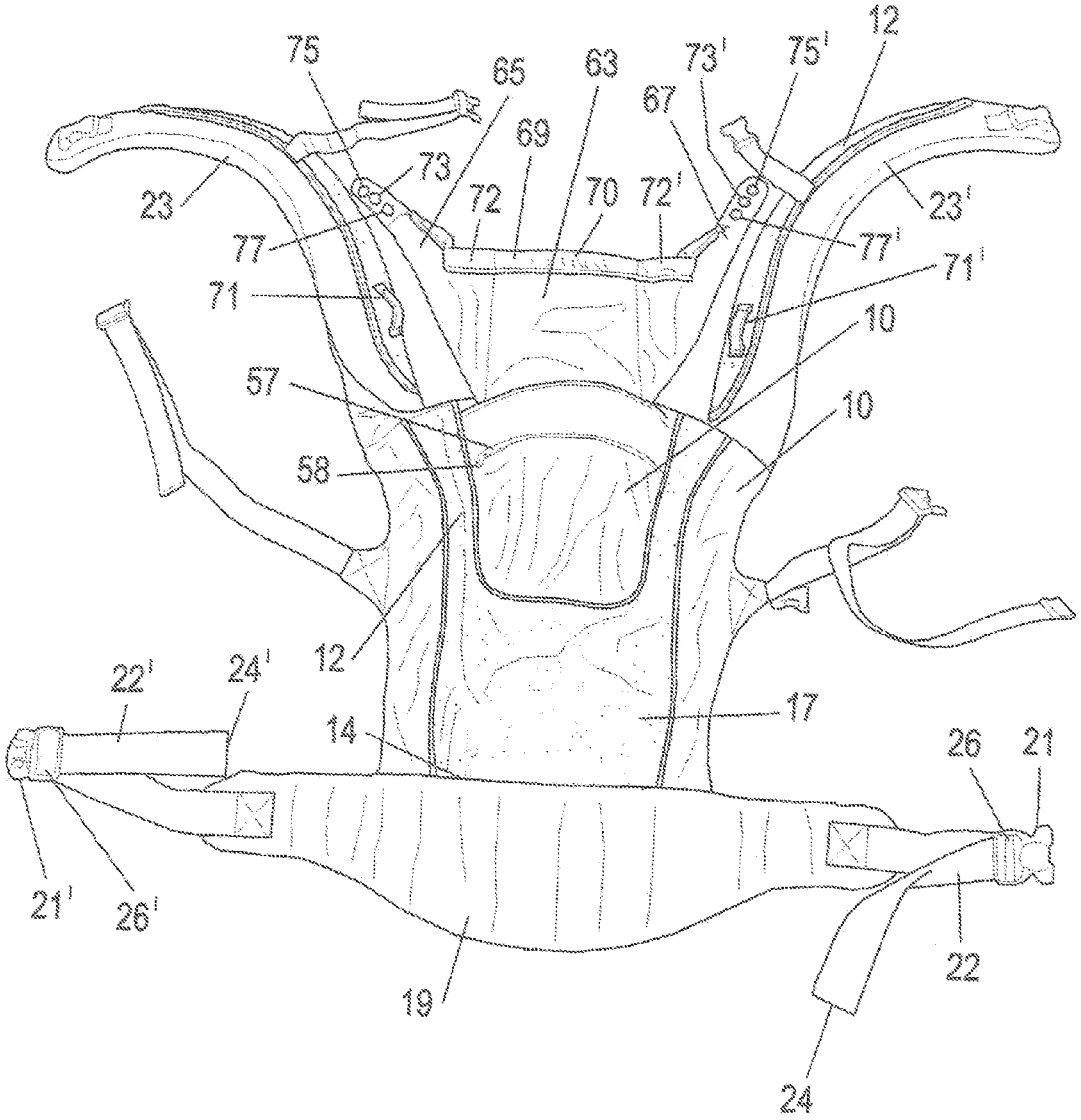
FIG. 5 is a front plan view of the carrier of FIG. 1.
Figure 6:
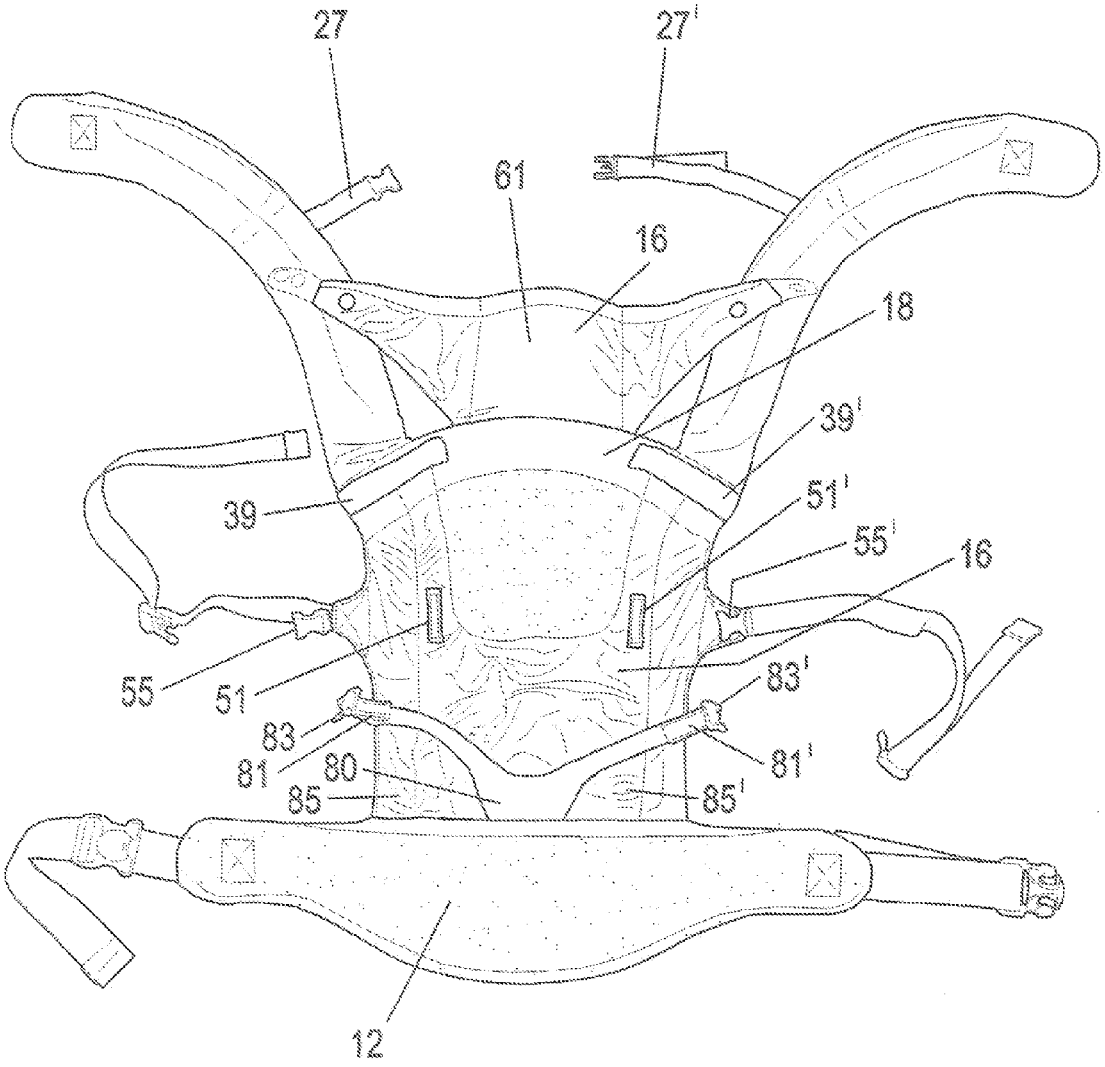
FIG. 6 is a rear plan view of the carrier of FIG. 1.
Figure 7:
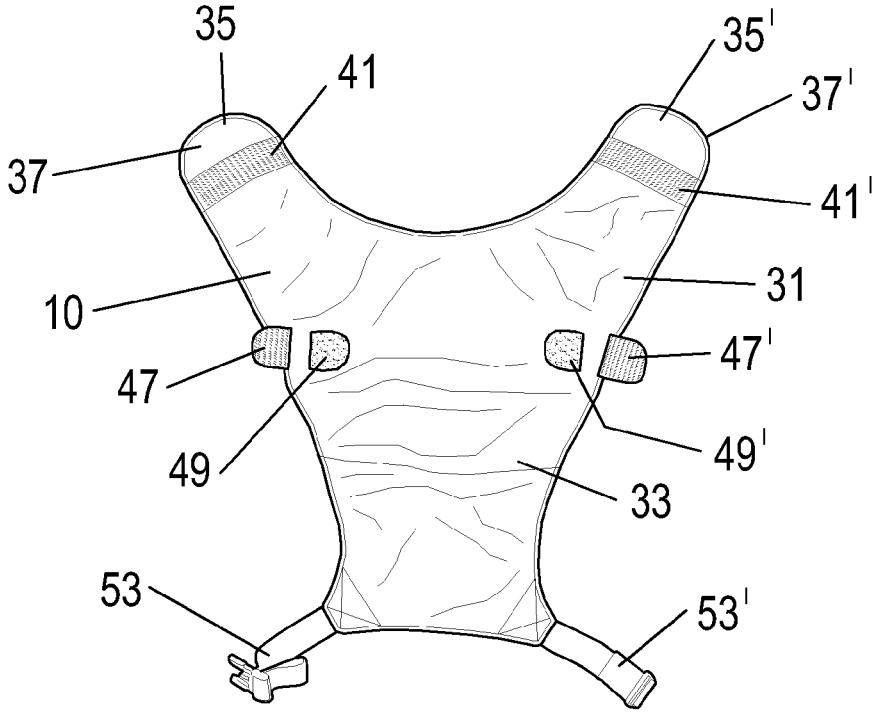
FIG. 7 is a rear view of a removable infant insert of the carrier shown in FIG. 1.
Figure 8:
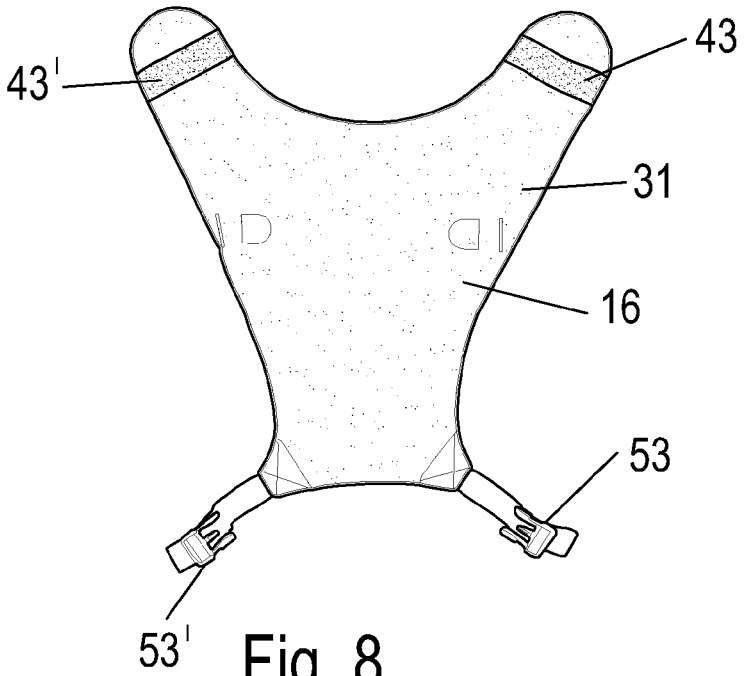
FIG. 8 is a front view of a removable infant insert of the carrier shown in FIG. 1.

Referring in detail to the FIGS. 1-12 there is shown an infant carrier 11 having an infant support member 13 for supporting preferably the rear or back and lower portion of an infant and a shoulder support system 15 to be secured around a wearer, typically an adult user. The combination infant support member 13 and shoulder support system 15 is symmetrical about a vertical axis. The infant support member 13 is defined by a continuous, semi-rectangular panel 17, as shown in FIG. 5, including in some portions, a layer of durable cotton blend fabric 10 and a separate mesh, breathable fabric 12 as well as an inner or bottom layer of soft, breathable fabric 16. The upper portion of the main panel support member 13 includes a padded portion 18 that provides support to an infant. A lower portion 14 of the main panel support member forms a slight pouch or support for an infant or toddler's lower body and is attached or joined to a waist band 19, defined by a length of padded material designed to encircle a waist of the wearer. A portion of the waist band 19 is elongated with a rounded lower portion and contains relatively stiff padding 20 throughout. The waist band 19 has straps 22, 22' that are secured to the padded portion of the waist band 19, a tri-lock buckle including buckle closure members 21, 21' and a buckle release button 25. The dual straps 22, 22' have free hemmed ends 24, 24' that are inserted through complementary closure/adjustment members 26, 26'. The waist band 19 has an outer surface covering of durable cotton blend fabric 10 and an inner surface layer of a soft, breathable mesh fabric 12 as shown in FIG. 6. The waist band 19 is designed to be adjustable for all users.

Figure 9:
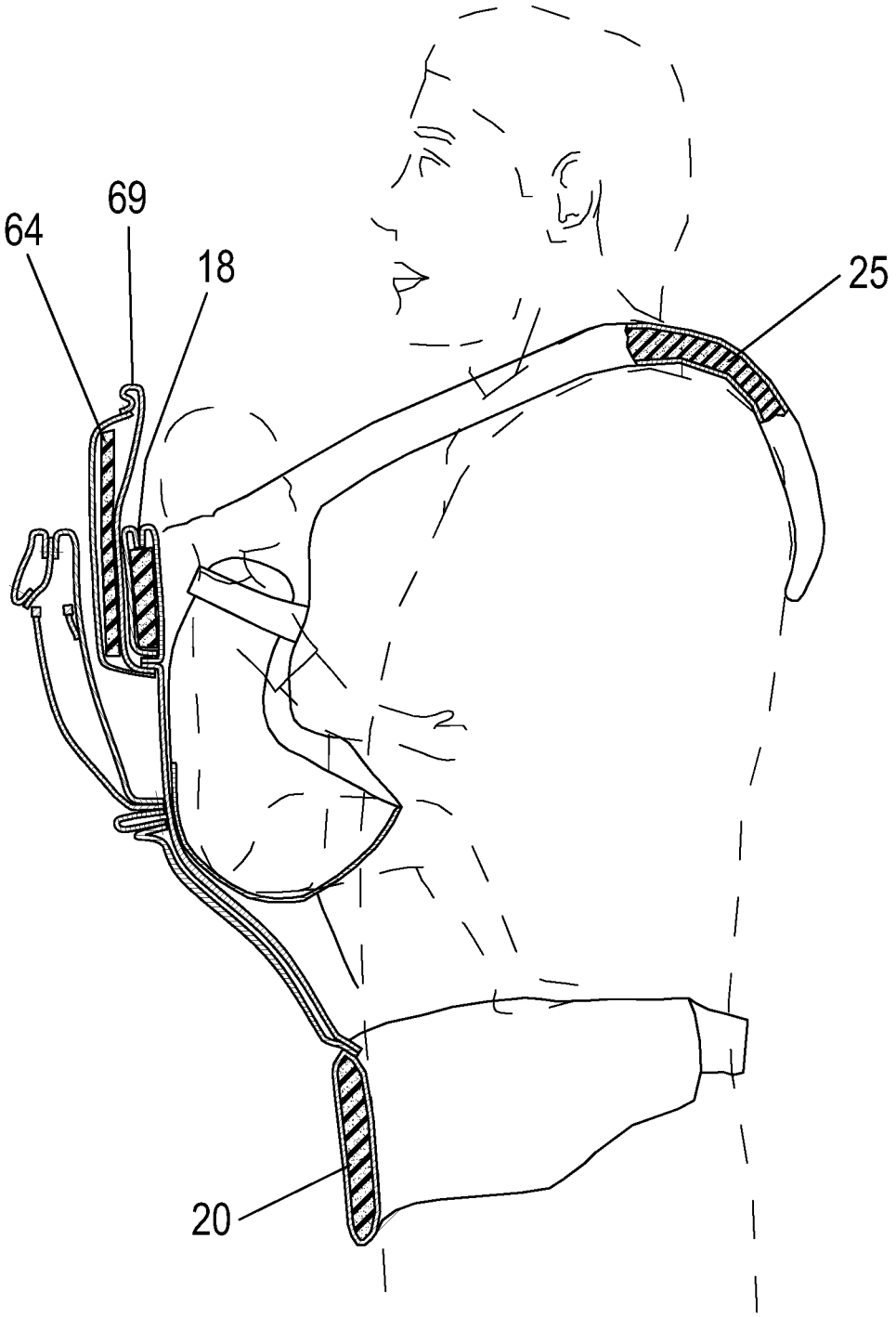
FIG. 9 is a sectional side view of the carrier of FIG. 1.
Figure 10:
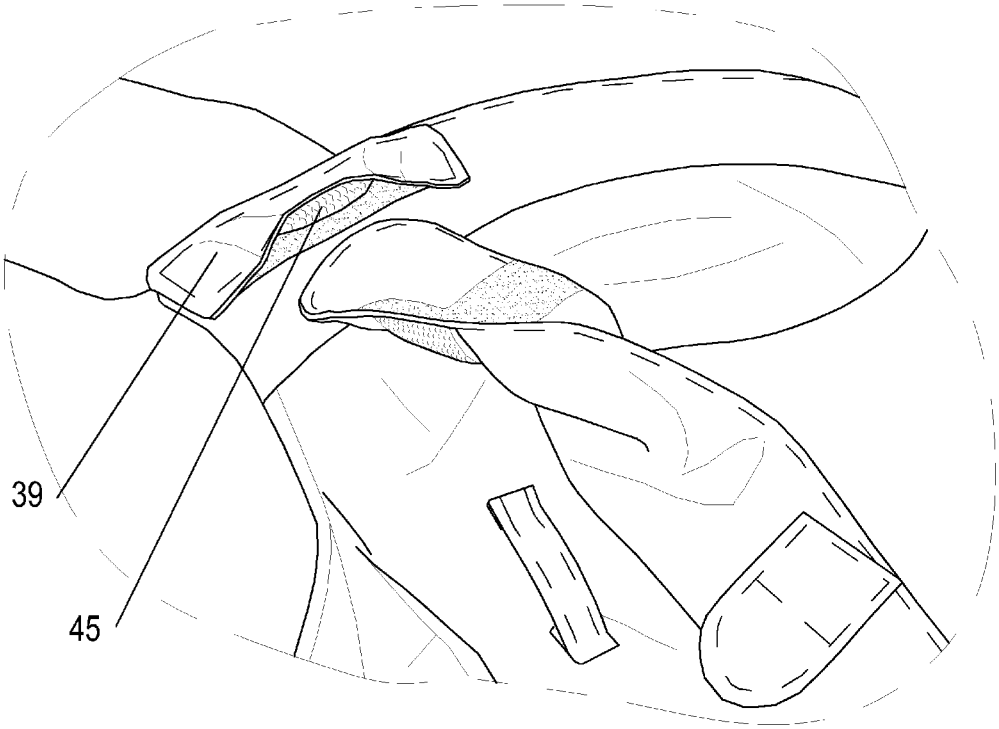
FIG. 10 is a cut away view of a securing portion of the removable infant insert shown in FIG. 4.

The shoulder support system 15 includes dual shoulder straps 23, 23' extending upwardly and outwardly from and located on opposite sides of the continuous panel 17. The shoulder straps 23, 23' include a moderate amount of padding 25, along the entire length of the straps as shown in FIG. 9. The dual shoulder straps 23, 23' include intermediate sternum/back strap adjustment members 27, 27' and lower shoulder strap adjustment members 29, 29'. The shoulder straps 23, 23' include buckle closure members 30, 30', 32, 32' and lower straps 34, 34'.

The infant carrier 11 includes a removable infant insert 31 to accommodate small infants and newborns allowing secure placement in the carrier as shown in FIGS. 4, 7, 8 and 9. The removable infant insert 31 is defined by at least two layers made up of a soft fabric 10 and a mesh fabric 16 forming a main panel 33 having dual arm members 35, 35' extending outwardly from an upper portion of the main panel 33, forming an X-shaped flat panel and terminating in rounded ends 37, 37'. The rounded ends 37, 37' are designed to be inserted through corresponding loops 39, 39' on the inner layer 16 of the back support member 13. The dual arm members 35, 35' also have alternating hook and loop bands 41, 41', 43, 43' which correspond to alternating hook and loop bands, band shown in FIG. 10, located along the interior of the corresponding loops 39, 39'. In this way, the dual arm members 35, 35' are securely anchored in place within the loops. The main panel also has tabs 47, 47' having hook and loop material along one surface of the tab. The tabs 47, 47' are inserted through corresponding intermediate loops 51, 51' on the back support member as shown in FIG. 6 and mate with corresponding hook and loop material 49, 49' located on an interior side of the main panel 16. The lower portion of the infant insert main panel 33 has outwardly extending straps 53, 53' for securement to corresponding buckle closures 55, 55' on a mid-portion of the carrier, forming at least six points of contact between the back support member and the infant insert. The carrier may be used with or without the insert, and the insert may be stored in a front auxiliary pocket 57 when not in use.

The back support member 13 includes a front storage pouch or pocket 57 extending transversely across the exterior upper portion of the main support panel. The pocket member 57 is shown in one embodiment with a zipper 58, but other forms of closure may also be used. An additional upper pocket member 59, located along an exterior upper portion of the main panel support member 13, is designed to secure and hold a pull-out headrest 61. The headrest 61 has a main body portion 63 that is padded 64 and dual wings 65 and 67 on opposite sides of the main body portion. A reinforced padded edge 69 is located along an upper portion of the headrest 61. The middle portion 70 of the padded edge 69 contains additional, stiffer padding than side reinforced padded edges 72, 72'. The dual wings 65, 67 may be releasably secured to an upper portion of the shoulder strap members with loops 71, 71' and dual snap closures 73, 73', 75, 75' located near terminal ends of the dual wings 65 and 67. The upper portion of the headrest 61 may be extended outwardly and upwardly from the upper pocket 59 and the dual wings 65 and 67 may be secured by placing terminal ends through the loops 71, 71' and securing one of the snap closures, 73 or 75; 73' or 75' to a corresponding snap closure 77, 77'. The headrest 61 is adjustable with the snap closures 73, 73' and 75, 75' depending upon the amount of room desired for the infant's head. The headrest 61 may be used for added infant head support or back and shoulder support for a larger infant.

A second form of carrier has a harness 80. The lower portion 14 of the main panel member 13 may also include the infant harness 80 on the interior having outwardly extending straps 81, 81' with buckle closures 83, 83' for securement to the corresponding buckle closures 55, 55' on a mid-portion of the carrier as shown in FIG. 6. The infant harness 80 may be used in situations where the removable infant insert 31 is removed and not in use.

In use, the infant carrier 11 may be adjusted based on the size of the infant to be placed within the carrier for use in the forward facing position. If a newborn or small infant is to be placed within the carrier, the removable infant insert 31 may be attached along the inner surface of the main panel support member 13 as described above. Next, the lower waist band 19 is secured around the waist of the wearer by buckling the dual closure/adjustment members 21, 21'. The free ends 24, 24' of the dual straps 22, 22' may be pulled outwardly to adjust the width of the waist belt to ensure a comfortable and snug fit around the waist of the wearer and provide balancing of the weight of the infant. Once attached for use in the forward facing position, the wearer should be in a seated position and the rear support member 13 of the carrier is placed on the wearer's lap or legs. The infant is placed on the seat portion of the back support member 13, including the removable insert 31 for a smaller infant, with the infant's legs placed on opposite sides of the wearer's torso. The lower portion of the infant insert main panel 33 has outwardly extending seat support straps 53, 53' that may be drawn up between an infant's legs for securement to corresponding buckle closures 55, 55' on a lower end of the shoulder support system. The straps 53, 53' may be adjusted based upon the size of the infant. In this way, the insert positions smaller infants higher in the carrier and prevents them from sitting too low in the carrier. The infant and carrier may then be raised to an upright position with the opposite shoulder straps 23, 23' being placed on the wearer and the sternum/back strap being secured and adjusted. If desired, the pull-out headrest 61 may be extended outwardly and upwardly from the pouch and secured along both sides of the infant's head. When not in use, the headrest 61 may be returned to the storage pouch or pocket 59.

If the removable insert 31 is not used, the insert should be removed from the carrier. The wearer should be in a seated position and the back support member 13 of the carrier is placed on the wearer's lap. Next, the lower waist band 19 is secured around the waist of the wearer by buckling the dual closure/adjustment members 21, 21'. The free ends 24, 24' of the dual straps 22, 22' may be pulled outwardly until snug to adjust the width of the waist belt to ensure a comfortable fit around the waist of the wearer and provide balancing of the weight of the infant. The infant is placed on the back member support portion with the infant's legs placed on opposite sides of the wearer's torso. The optional infant harness 80 with outwardly extending straps 81, 81' may be drawn up between an infant's legs and the buckle closures 83, 83' may be secured to corresponding buckle closures 55, 55' on the shoulder support system forming leg openings 85, 85'. The infant and carrier may then be raised to an upright position with the opposite shoulder straps 23, 23' being placed on the wearer and the sternum/back strap being secured and adjusted. If desired, the pull-out headrest 61 may be partially removed from the pouch and secured along both sides of the infant's head. When not in use, the headrest 61 may be returned to the storage pouch or pocket 59.

Figure 11:
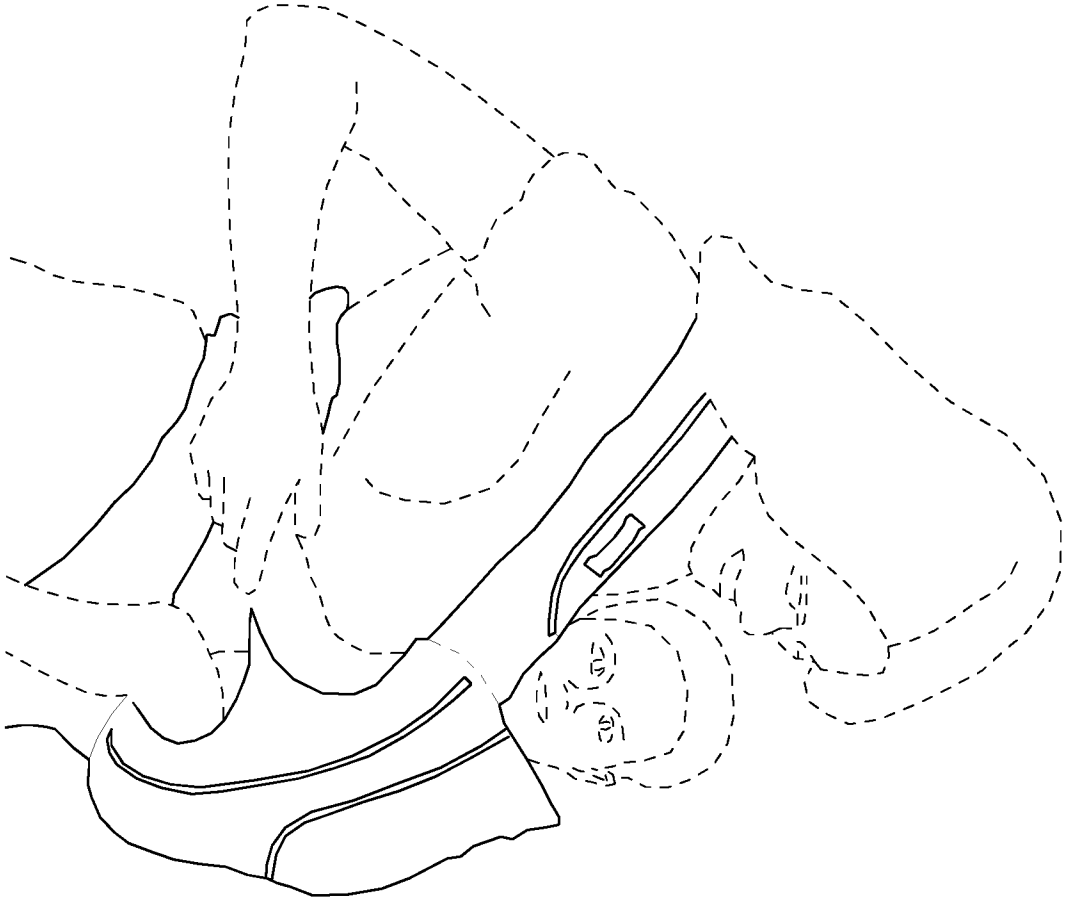
FIG. 11 is a perspective view of the carrier of FIG. 1 demonstrating the carrier used as a hip carrier.

If the carrier is to be used as a hip carrier as shown in FIG. 11, the lower waist band 19 is secured around the waist of the wearer by buckling the dual closure/adjustment members 21, 21'. The free ends 24, 24' of the dual straps 22, 22' may be pulled outwardly to adjust the width of the waist belt to ensure a comfortable fit around the waist of the wearer and provide balancing of the weight of the infant. The waist band 19 should then be adjusted around the wearer's body so that the pouch 13 is shifted on to the hip of the wearer. The shoulder straps 23, 23' should be unbuckled and allowed to hang loose. The infant harness 80 with the buckle closures 83, 83' may be secured to corresponding buckle closures 55, 55' forming leg openings 85, 85'. The shoulder strap 23 should be secured with buckle closure 30, 32 and allowed to hang down in front of the wearer. The infant may be picked up and straddled on the hip of the wearer and the infant's legs may be inserted through the leg openings 85, 85'. The main panel support member 13 should be directly behind the infant's back so that the infant can be lowered into the seat portion of the support member. The buckled shoulder strap 23 may then be raised across the shoulder of the wearer and tightened. Shoulder strap 23' may be placed beneath the arm of the wearer and secured across the back of the wearer.

Figure 12:
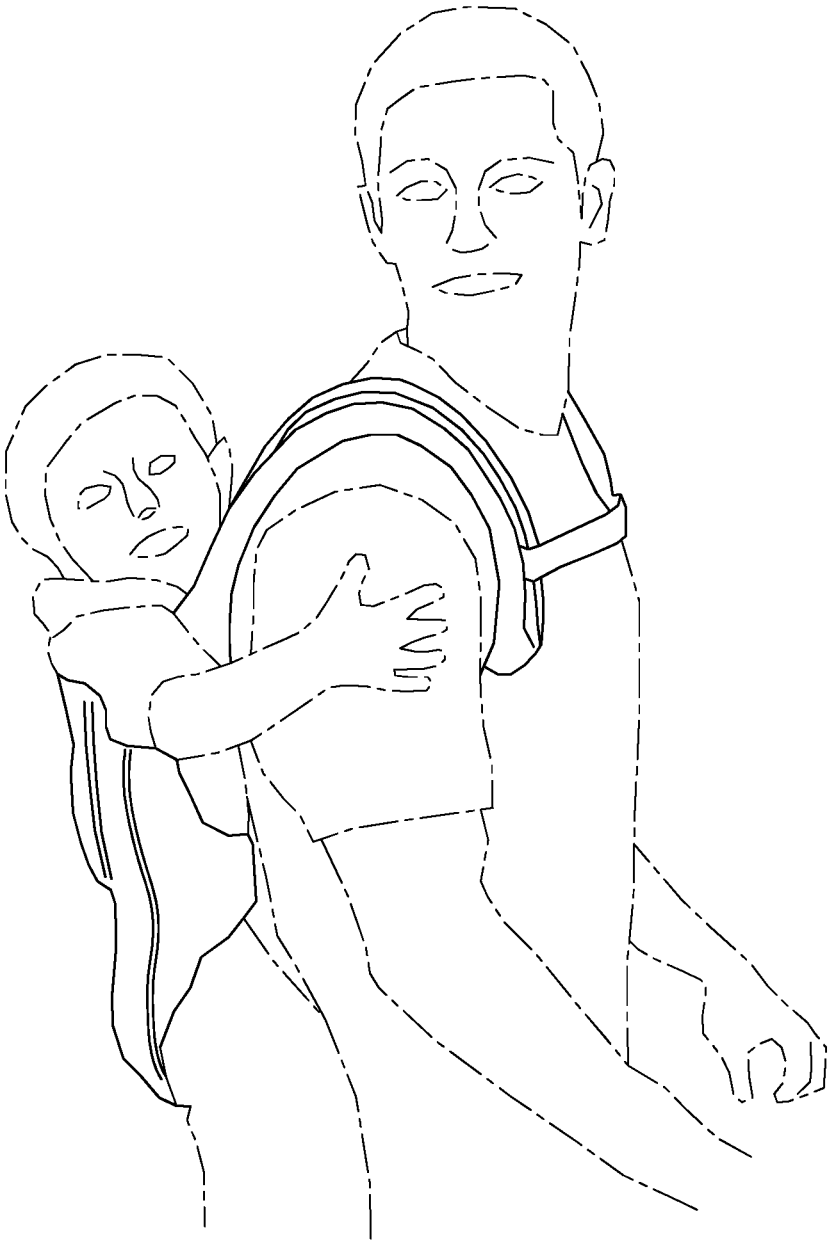
FIG. 12 is a perspective view of the carrier of FIG. 1 demonstrating the carrier used as a back carrier.

If the carrier is to be used as shown in FIG. 12, the lower waist band 19 is secured around the waist of the wearer by buckling the dual closure/adjustment members 21, 21'. The free ends 24, 24' of the dual straps 22, 22' may be pulled outwardly to adjust the width of the waist belt to ensure a comfortable and snug fit around the waist of the wearer and provide balancing of the weight of the infant. With assistance from another adult, the larger infant may be placed facing against the back of the wearer, sliding the infant's feet through the leg openings 85, 85'. The back support member 13 should be directly behind the infant's back so that the infant can be lowered into the seat portion. The opposite shoulder straps 23, 23' should be placed on the wearer and the sternum/back strap secured and adjusted.

The configuration of the back support member in combination with the back support system, allows an infant to be carried next to the chest or back of the wearer without any type of wall or material separating the infant from the wearer. Further the configuration of the carrier prevents undue tangling of the carrier and allows for ease of use.

It is therefore to be understood that even though numerous characteristics and advantages of the embodiments shown and described have been set forth in the foregoing description, together with the details of the structure and function of the embodiments, the disclosure is illustrative only, and changes may be made within the principles of the embodiments to the full extent indicated by the broad general meaning of the terms and reasonable equivalents thereof.

We claim:

1. A convertible infant carrier comprising:

A semi-rectangular continuous panel having a rounded upper edge, dual adjustable shoulder support straps extending upwardly and outwardly from and located on opposite sides of said continuous panel, and a lower edge joined to a waist band;

said shoulder support straps having ends releasably secured to lower strap members, said lower strap members having terminal ends secured to a mid-portion of said continuous panel;

said padded waist band having an adjustable length that is releasably and circumferentially secured around the hips of a user;

said rounded upper edge including an infant head rest securable to opposite sides of the shoulder supports and storable in an upper front pocket; and a removable infant insert comprising a flat, X-shaped panel having at least six securing points on said continuous panel for support of smaller infants within the carrier.

2. The carrier according to claim 1 wherein said support straps are symmetrical about a vertical axis.

3. The carrier according to claim 1 wherein said infant head rest is stored within said pocket on an exterior surface of an upper portion of said continuous panel.

4. The carrier according to claim 1 wherein said shoulder support straps are padded.

5. The carrier according to claim 1 wherein said shoulder straps include at least one adjustment member.

6. The carrier according to claim 1 wherein said carrier is convertible between uses for different sized infants.

7. The carrier according to claim 1 wherein said continuous panel includes a seat support harness.

8. The carrier according to claim 1 wherein said main panel support includes interior attachment members for said infant insert.

9. The carrier according to claim 8 wherein said attachment members include hook and loop bands.

10. The carrier according to claim 1, further comprising first and second buckle members on said infant insert coupled to corresponding buckle members on said main panel.

11. The carrier according to claim 1 wherein a portion of said main panel support is comprised of at least three layers of fabric.

12. An infant carrier comprising:

dual, padded shoulder straps connected at one end to an upper portion of a main panel member and connected at a second end to a mid-portion of said panel member;

said main panel member defined by at least one layer of breathable fabric and a reinforced lower portion;

a lower padded, circumferential waist belt support joined to a lower end of said main panel, said waist belt support having terminal ends that are secured to one another; and a removable infant insert having outwardly extending arm members forming an X-shaped flat panel, dual mid-portion fasteners and upper and lower attachment members that correspond to attachment members located on said main panel member.

13. The infant carrier according to claim 12 wherein said main panel includes an infant head rest securable to opposite sides of the shoulder straps.

14. The infant carrier according to claim 12 wherein said infant insert includes corresponding hook and loop fasteners on said arm members for securement to said main panel.

15. A method of securing an infant in an infant carrier, the steps comprising;

securing a circumferential waist belt around the entire waist of a wearer;

placing a main panel support member of the infant carrier along the lap of a wearer;

placing an infant on top of the carrier on the lap of the wearer;

pulling an infant insert between the legs of an infant and attaching the insert to side buckles;

securing six points of connection between the infant insert and the main panel support member;

bringing the infant and carrier forward into an upright position raising each shoulder strap over the shoulders of the wearer while supporting the infant;

securing the sternum/back strap and adjust said strap for comfort; and removing a headrest from an exterior auxiliary storage member and securing side wings to upper portions of said shoulder straps.

16. The method according to claim 15 wherein said infant insert is secured to an interior of said main panel member with hook and loop fasteners.

17. The method according to claim 15 wherein smaller infants may be placed within said infant insert.

* * * * *